United States Patent [19]

Harris

[11] Patent Number: 5,067,928

[45] Date of Patent: Nov. 26, 1991

[54] COIN AND/OR TOKEN OPERATED AND HANDLING APPARATUS

[76] Inventor: Gary L. Harris, 323 Cuzco Ct., Henderson, Nev. 89014

[21] Appl. No.: 608,527

[22] Filed: Nov. 2, 1990

[51] Int. Cl.[5] ..... G07D 1/00

[52] U.S. Cl. ..... 453/17; 453/18; 414/304; 222/390

[58] Field of Search ..... 453/16, 17, 18, 32, 453/56, 57; 414/304, 417; 221/192; 222/390; 187/24

[56] References Cited

U.S. PATENT DOCUMENTS

| | | | |
|---|---|---|---|
| 399,197 | 3/1889 | Hawkins | 222/390 X |
| 4,342,384 | 8/1982 | Fukase et al. | 453/56 X |
| 4,412,550 | 11/1983 | Watanabe et al. | 453/61 |
| 4,687,089 | 8/1987 | Wuethrich | 453/53 X |

FOREIGN PATENT DOCUMENTS

| | | | |
|---|---|---|---|
| 0287049 | 10/1988 | European Pat. Off. | 453/32 |
| 221783 | 2/1990 | United Kingdom | 453/17 |

*Primary Examiner*—F. J. Bartuska
*Attorney, Agent, or Firm*—Philip D. Junkins

[57] ABSTRACT

Supplemental coin and/or token storage, transportation and dispensing apparatus for coin and/or token operated and handling machines whereby the coin and/or token payout hopper of such machines may be rapidly replenished with coins and/or tokens. The supplemental storage, transportation and dispensing apparatus of the invention includes a coin and/or token elevator having an upwardly and downwardly movable coin and token platform and an elevator controller mechanism which is responsive to a coin and token level sensor within the payout hopper and to coin and token level and elevator platform level sensors in the elevator.

8 Claims, 2 Drawing Sheets

COIN AND/OR TOKEN OPERATED AND HANDLING APPARATUS

BACKGROUND OF THE INVENTION

1. Field of the Invention

The apparatus and system of the present invention relate to coin and/or token operated and handling machines that have the capability of receiving, accepting and/or rejecting, storing and dispensing coins and/or tokens.

2. Description of the Prior Art

Most prior art coin and/or token operated and handling machines have a coin and/or token entry slot and utilize a coin and/or token acceptor device designed to either accept or reject each coin or token. Such machines also normally have a coin and/or token diverter (or deflector) mechanism to direct accepted coins and/or tokens to either a hopper payout assembly or a coin and/or token storage chamber, commonly referred to as a drop box or a drop bucket. The diverter mechanism normally directs accepted coins or tokens to the hopper assembly until it is full after which the diverter mechanism directs coins and/or tokens to the drop bucket. In such machines coins or tokens that are initially rejected by the acceptor device drop through a reject chute or coin tray chute directly into a coin or token delivery (or payout) tray. Accepted coins and/or tokens, diverted to the hopper payout assembly, at times of payout, drop from the hopper assembly into the delivery tray.

Coin and/or token operated machines of the type described above are controlled by a controller mechanism which includes electronic circuitry which directs the hopper payout assembly to release or payout coins or tokens in accordance with machine-determined and/or set parameters. Such machines also include coin and/or token sensing devices associated with the hopper payout assembly, and interconnected through the controller mechanism to the diverter mechanism whereby, when the payout hopper is less than full, accepted coins and/or tokens are diverted to such hopper and when such hopper is full accepted coins and/or tokens are directed to the drop bucket.

The prior art coin and/or token machines are perfectly satisfactory in structure and operation so long as the machine-determined and/or set parameters do not suddenly require an immediate high volume payout or discharge of coins or tokens, or a rapid sequence of coin or token payouts or discharges, which exhausts the supply of coins and/or tokens within the payout hopper. On such occasions the machine's controller mechanism, interconnected with the hopper's coin and/or token sensing devices, signals a machine attendant that the machine's hopper is empty. The machine then goes into a hopper time out mode thus deactivating the machine until the empty hopper situation is corrected. A machine attendant is summoned to the machine and, after shutting the machine down, performs a "manual hopper fill." A hopper fill is usually accomplished by obtaining a bag of coins and/or tokens from a source external to, and apart from, the machine. Such "manual hopper fill" procedure creates substantial delay in the operation of the machine. At times this delay causes the person operating the machine to become upset and distressed with the machine's proprietor.

It is an object of the present invention to provide a supplemental coin and/or token storage, transport and dispensing mechanism for coin and/or token operated and handling machines which reacts instantly and automatically to replenish the payout hopper thereof with coins and/or tokens upon sensor indication to the controller mechanism of such machines that the hopper's supply of coins and/or tokens is near or at the point of exhaustion.

It is a further object of the invention to provide a supplemental coin and/or token storage, transport and dispensing mechanism for coin and token operated and handling machines which receives accepted coins and/or tokens from the diverter mechanism of such machines and, upon direction by the invention's controller mechanism thereof, initially fills and thereafter rapidly replenishes the payout hopper with accepted coins and/or tokens.

It is still a further object of the invention to provide a coin and/or token storage, transport and dispensing elevator mechanism for incorporation in coin and/or token operated and handling machines whereby the payout hopper of such machines may be rapidly replenished with coins and/or tokens when a full payout or partial payout of the coins and/or tokens in the hopper, or successive hopper payouts, substantially depleats or exhausts the supply of coins and/or tokens therein before a suitable volume of acceptable coins and/or tokens may be fed to the hopper via the diverter mechanism of such machines.

It is yet another object of the invention to provide a system for incorporation in coin and/or token operated and handling machines whereby the payout hoppers thereof may be automatically replenished with coins and /or tokens when the hopper becomes rapidly emptied as the result of a full or partial payout of coins and tokens therefrom.

Other objects and advantages of the invention will be apparent from the following summary and detailed description of the invention, taken with the accompanying drawing figures. For the purpose of describing the invention in the summary, detailed description and appended claims, the term "coins" will be used to describe the objects or monitory units of machine use and manipulation and the reference to "coins" shall mean coins and/or tokens and the equivalents of coins and tokens.

SUMMARY OF THE INVENTION

The present invention relates to a supplemental coin storage (containment), transportation and dispensing apparatus and system which may be installed in prior art coin operated and handling machines whereby the payout hopper of such machines may be rapidly replenished with coins, from the supplemental apparatus, when the payout hopper is depleted of coins because of a full or partial coin payout or because of a rapid succession of payouts. The supplemental coin apparatus comprises a hopper coin elevator and elevator controller mechanism with the capability of providing the hopper with rapid automatic coin fills when the level of coins within the hopper reaches a low level.

Thus, in accordance with the invention coins are fed into the coin entry slot of the coin operated and handling machine. Each coin travels through a coin acceptor device which either accepts or rejects the coin. Rejected coins are directed to a rejected coin chute and travel therethrough directly to the coin delivery tray or coin payout tray of the machine. Accepted coins are directed by the acceptor device to a coin diverter (or deflector) mechanism.

The coin diverter mechanism is controlled by a machine controller mechanism which is electrically interconnected to coin level sensing devices. One coin level sensing device is located within the coin payout hopper proximate the top of the hopper to indicate when the coin level within the hopper has reached (or is at) its designated "full level" or to indicate when the hopper requires a coin fill (addition of coins) because the hopper is sensed to be not full.

The other coin level sensing devices, in accordance with the present invention, are located within a coin supply elevator which is associated with the coin hopper assembly. The coin supply elevator (previously described as the elongated supplemental coin storage, transport and dispensing apparatus of the invention) includes an upwardly and downwardly moveable coin platen or elevator coin platform within the elevator's housing. A first elevator coin level sensing device (threshold sensor) is located within the elevator (proximate the upper end of the elevator and proximate the lower edge of the coin discharge port leading from the elevator to the open top of the coin hopper) to indicate to the elevator controller mechanism when the coin hopper is full and to maintain the threshold position (level) of coins contained within the elevator. A second elevator coin level sensing device (diverter sensor) is located within the elevator (proximate its lower end) to indicate to the elevator controller mechanism and the machine controller mechanism (in cooperation with indication by the threshold sensor) when the elevator is filled with coins and thereby direct the coin diverter mechanism to direct incoming coins to the coin drop bucket.

The coin supply elevator also includes platform level sensing devices interconnected with the elevator controller mechanism. A first platform sensing device within the coin elevator housing is located proximate the upper end thereof to indicate to the elevator controller mechanism when the coin platform (within the elevator housing) has reached its highest permissible level of travel so that the elevator controller can shut off the electrical motor drive mechanism lifting the coin platform. A second platform sensing device is located proximate the lower end of the elevator housing and indicates when the elevator platform has reached its lowest permissible level of travel within the elevator housing. When the elevator platform is at its lowest level within the elevator housing and the column of coins within the elevator has reached the first coin level sensing device at the upper end of the elevator (threshold sensor), the elevator has attained a "full" status.

When the coin operated and handling apparatus of the invention is initially readied for operation the coin hopper thereof is filled with coins. Also, the coin elevator has its coin platform set at a low position within the elevator housing and the elevator is loaded with coins to the level of the upper threshold sensor. In some instances the elevator platform may be lowered to its lowest position within the elevator housing and then the elevator filled to its maximum fill condition. In this case, the elevator controller mechanism, through its interconnection with the coin level sensing device within the payout hopper and the coin level sensors within the coin elevator, initially instructs the coin diverter mechanism to direct accepted coins through a drop chute directly to the drop box or drop bucket of the apparatus. As coins are paid out by the hopper payout assembly the top level of coins in the hopper drops below the top sensor of the hopper and the elevator controller mechanism instructs the elevator to fill the hopper. As the elevator platform rises to accomplish the hopper fill, the diverter sensor lower position within the elevator) is deactivated. When the level of coins in the payout hopper has reached its full level, the hopper sensor signals the elevator controller mechanism and such controller mechanism activates the elevator's threshold sensor. If the level of coins in the elevator is above the position of the threshold sensor, the elevator controller mechanism lowers the elevator platform until its proper position is attained. If the diverter sensor at the lower end of the elevator remains deactivated the coin diverter mechanism directs accepted coins to the coin elevator for flow from the top of the column of coins therein through the elevator's coin discharge port to the hopper for deposit at the top of the column of coins therein.

In the event of an immediate high volume payout or discharge of coins from the payout hopper the level of coins therein may suddenly drop below the hopper sensor within the hopper. The elevator controller mechanism instantly instructs the coin elevator to refill the hopper by rapid upward movement of the coin platform whereby coins from the column of coins within the elevator are discharged through the elevator's coin discharge port into the hopper. The discharge of coins from the coin elevator into the coin hopper is assisted by a coin mixing device located at the top of the coin supply elevator. When the hopper has been refilled as sensed by the hopper sensor, the elevator controller mechanism (through its electrical interconnection with the combination of sensors within the elevator housing) instructs the elevator's coin platform to descend within the housing to the prescribed threshold position and instructs the diverter mechanism of the apparatus and system to direct accepted coins into the coin elevator. At such time as the payout hopper and the coin elevator are again both at their "full" status (as established by the sensor of the hopper and the lower coin platform and upper coin level sensors of the elevator) the controller mechanism instructs the diverter mechanism to again direct accepted coins to the drop bucket.

Through the supplemental coin storage, transportation and dispensing apparatus (coin supply elevator) and system of the invention there is provided means within coin operated and handling machines for substantially reducing the need for emergency "manual hopper fills" when such machines experience full payouts of coins which require the discharge of all coins within the payout hopper.

BRIEF DESCRIPTION OF THE DRAWING FIGURES

The invention as summarized above, and the foregoing objects, features and advantages of the invention will become more apparent hereinafter from the following detailed description of the invention taken in conjunction with the accompanying drawing figures wherein.

DETAILED DESCRIPTION OF THE INVENTION

Figure 1:
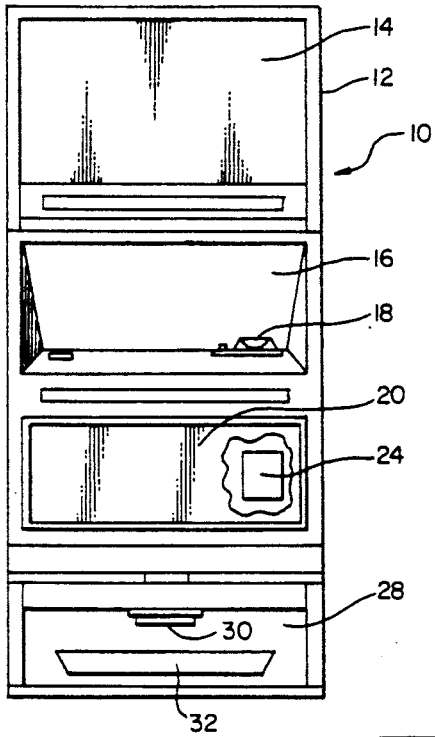
FIG. 1. PRIOR ART
FIG. 1 is a front view of a coin or token operated and handling apparatus of the prior art.

Referring now to the drawings, FIG. 1 is a front view of the upper portion of a typical prior art coin operated and handling apparatus 10. The apparatus 10 comprises a cabinet structure 12 which supports and encloses (generally): an upper "award glass" or other display 14; a lower video or other display region 16 including a coin entry slot 18; a "belly glass" area 20 behind which is located the intermediate coin handling section of the apparatus including a coin acceptor device (not visible), a coin diverter 24, and a coin payout hopper (not visible); and a lower coin delivery or payout section 28 including a payout or coin discharge port 30 and coin tray 32. The apparatus 10 also contains appropriate controller means (not visible) which is electrically interconnected to coin level sensing devices within the coin hopper and to the coin diverter 24.

Figure 2:
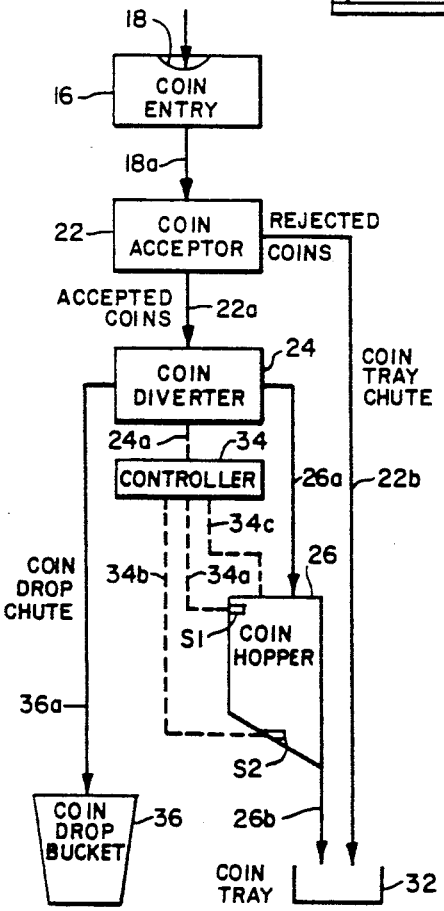
FIG. 2. PRIOR ART
FIG. 2 is a block diagram of the internal components of the prior art coin or token operated and handling apparatus of FIG. 1.

In FIG. 2 there is illustrated, in schematic block diagram format, the internal components of the prior art coin operated and handling apparatus of FIG. 1, including the coin flow paths between the coin handling components thereof and the electrical interconnections between the controller mechanism and the coin diverter and coin hopper of the apparatus. Thus, there is shown: coin entry section 16 and its coin entry slot 18; coin acceptor device 22; coin diverter mechanism 24; coin payout hopper 26; controller mechanism 34; coin delivery or payout tray 32; and a coin drop bucket (coin storage chamber) 36. In accordance with the operation of the prior art coin operated and handling apparatus coins are fed to the apparatus through coin entry slot 18 and pass via a coin entry chute 18*a* to the coin acceptor device 22 (of known design and operation). Accepted coins pass via an accepted coin chute 22*a* to coin diverter mechanism 24 whereas rejected coins drop via a coin reject chute 22*b* to the coin delivery or payout tray 32.

The coin diverter mechanism 24 (of known design and operation) is instructed by controller mechanism 34 (through electrical conductor 24*a*) to direct the coins received by the diverter to coin payout hopper 26 via hopper input chute 26*a* or to drop bucket 36 via coin drop chute 36*a*. In typical prior art coin operated and handling apparatus the controller mechanism 34 is interconnected only to a coin level sensor S1 within the coin payout hopper 26 (proximate the top thereof) through electrical conductor 34*a*. In some prior art machines the controller mechanism 34 is also interconnected to a lower coin level sensor S2 within such hopper through electrical conductor 34*b*. In the typical form of prior art apparatus, when hopper 26 is full of coins, as sensed by sensor S1, the controller mechanism instructs the diverter mechanism 24 to direct accepted coins to the drop bucket 36 via coin drop chute 36*a*. when the coins within the hopper 26 are no longer at their maximum capacity level (as determined by sensor S1), the controller mechanism instructs the diverter mechanism to direct accepted coins to the hopper 26 until such time as sensor S1 signals the controller that the hopper has been refilled to maximum capacity with coins.

The controller mechanism 34 also is electrically interconnected to apparatus components (not shown) within the coin operated and handling machine which determine the payout or discharge of coins from the machine (via the coin payout hopper) in accordance with machine determined and/or manual preset parameters. Thus, the controller mechanism, through electrical conductor 34*c*, directs (from time-to-time) the payout of coins from the hopper 26 via hopper out chute 26*b* into the coin tray 32.

Figure 3:
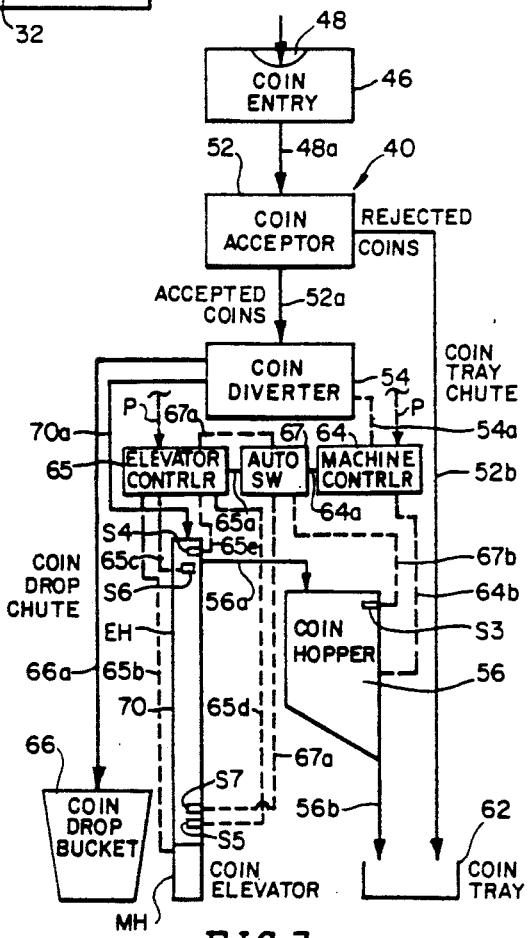
FIG. 3 is a block diagram of the internal components of a coin or token operated and handling apparatus and system of the present invention, including the coin or token supply elevator section of such apparatus.

Referring now to FIG. 3 of the drawing sheets, there is illustrated, in schematic block diagram format, the internal components of coin operated and handling apparatus including the unique supplemental coin storage (containment), transportation and dispensing apparatus (coin elevator) and system of the present invention. The diagram includes the coin flow paths (solid flow lines) between the coin handling components of the apparatus and system and the electrical interconnections (dashed interconnect lines) between the system's machine controller and elevator controller mechanisms, and the coin diverter, coin payout hopper and the unique coin elevator which provides the system with an "automatic" supplemental supply of coins so that "manual fills" of the payout hopper are almost completely avoided. Thus, there is shown a coin operated and handling apparatus 40 which is comprised of: a coin entry section 46 and its coin entry slot 48; a coin accepter device 52; a coin diverter mechanism 54; a coin payout hopper 56; a machine controller mechanism 64; an elevator controller mechanism 65; a coin delivery or payout tray 62; a coin drop bucket (coin storage chamber) 66; and a coin supply elevator 70.

Figure 5:
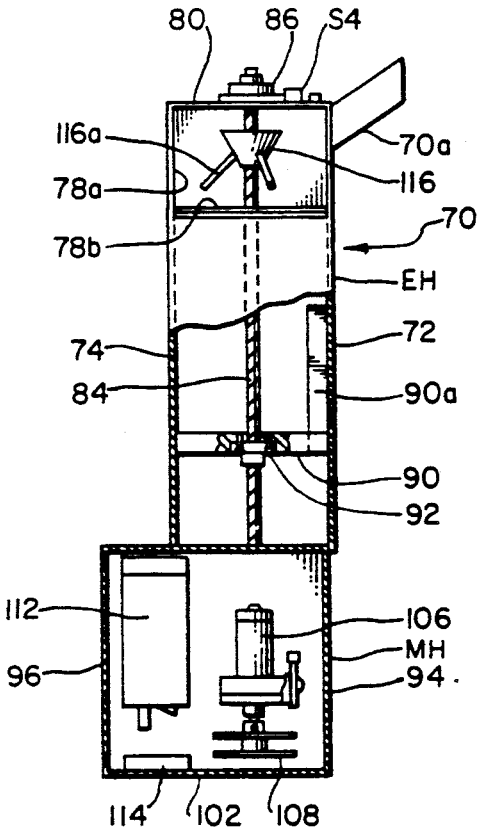
FIG. 5 is a side sectional view of the coin or token elevator of FIG. 4.
Figure 4:
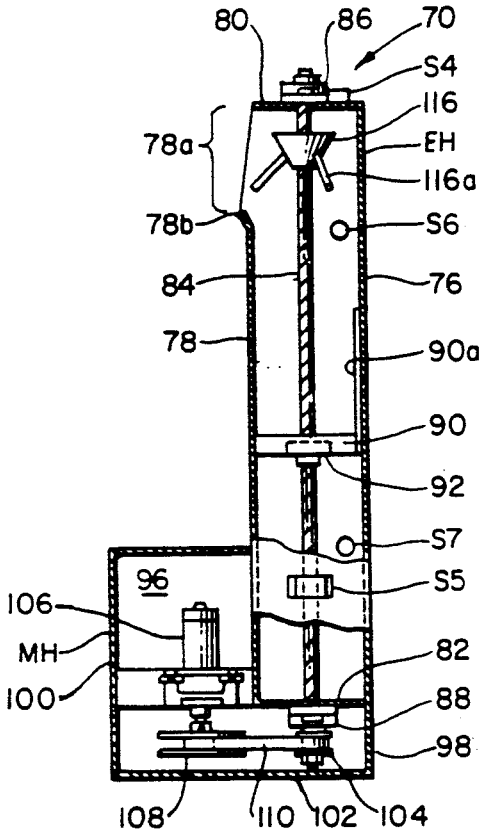
FIG. 4 is a front sectional view of the coin or token supply elevator of the invention, including the moveable coin or token platen, platen support and lift drive shaft, and coin or token mixer of the elevator.

In accordance with the operation of coin handling apparatus 40 of the invention, coins are fed to the apparatus through coin entry slot 48 and pass via a coin entry chute 48*a* to the coin acceptor device 52 (of known design and operation). Accepted coins pass via an accepted coin chute 52*a* to coin diverter mechanism 54 whereas rejected coins drop via a rejected coin chute 52*b* to the coin delivery or payout tray 62. The coin diverter mechanism (of known design and operation) is instructed by machine controller mechanism 64 (through electrical conductor 54*a*) to direct the coins received by the diverter to coin supply elevator 70 via elevator input chute 70*a* or to drop bucket 66 via coin drop chute 66*a*. A preferred embodiment of the coin supply elevator 70 is shown in FIGS. 4 and 5 and is described in detail hereinafter.

The machine controller mechanism 64 and the elevator controller mechanism 65 are interconnected through an auto-switch 67 via electrical conductors 64*a* and 65*a*. The auto-switch 67 is essentially a relay located on the circuit board of the elevator controller mechanism which operates to protect the system when there is a power failure. The machine controller mechanism 64 is interconnected to the coin level sensor S3 within the coin payout hopper 56 via auto-switch mechanism 67 through electrical conductor 64*a* and electrical conductor 67*b*. The elevator controller mechanism 65 is also interconnected to the hopper coin level sensor S3 within hopper 56 through the auto-switch 67 via electrical conductors 65*a* and 67*b*. The elevator controller mechanism 65 is interconnected to the upper coin level sensor S6 (coin threshold sensor) within the elevator 70 via electrical conductor 66*a*. Further, the elevator controller mechanism 65 is interconnected to the lower coin level sensor S7 through the auto-switch 67 via electrical conductors 67*a* and 65*a*. Finally, the elevator controller mechanism 65 is interconnected to the elevator platform level sensors S4 and S5 within the elevator 70 via electrical conductors 65*e* and 65*d*, respectively. The platform level sensor S4 is located proximate the upper end of elevator 70 to indicate when the coin platform within the elevator housing EH) has reached its highest permissible level of travel and to inform the elevator controller mechanism 65 that the coin supply elevator is nearly empty. Platform level sensing device S5 is located proximate the lower end of the elevator housing EH and indicates when the elevator's coin platform has reached its lowest permissible level of travel within the elevator housing.

The coin level sensing device S6 (threshold sensor), in electrical communication with the elevator controller mechanism 65 via conductor 65*c*, is located at a level proximate the lower edge of the coin discharge port leading from the elevator 70 to the open top of the coin hopper 56 and such sensing device indicates when the top of the column of coins within the elevator is at the lower edge of such coin discharge port. The flow of coins from the discharge port of elevator 70 to the top of coin hopper 56 is illustrated diagrammatically in FIG. 3 via flow line 56*a*. Coins are discharged from, or paid out by, the hopper 56 via hopper out chute 56*b*. When the elevator platform is at its lowest level within the elevator housing EH, as indicated by the lower platform level sensor S5, and the column of coins within the elevator has reached the upper coin level sensor S6, the elevator has attained a "full" status.

When the coin operated and handling apparatus of the invention is initially readied for operation, the coin hopper 56 is manually filled with coins. Also, the coin elevator 70 has its coin platform set at a lower position and the elevator is manually filled with coins. In operation, the machine controller mechanism 64 of the apparatus and system, through its interconnection (via conductor 64*a*, auto-switch 67 and conductor 67*b*) with the coin level sensing device S3 within the payout hopper 56 and through its interconnection (via conductor 64*a*, auto-switch 67, conductor 65*a*, elevator controller mechanism 65 and conductors 66*c* and 67*a*) with the coin level sensing devices S6 and S7 within the coin elevator, initially instructs the coin diverter mechanism 54 to direct accepted coins through drop chute 66*a* to drop bucket 66. As coins are discharged from, or paid out by, the coin hopper 56 (in response to instructions from the machine controller mechanism 64 to such hopper via conductor 64*b*) the top level of coins in the hopper drops below the coin level sensor S3 of the hopper and the machine controller mechanism 64 and the elevator controller mechanism 65 receive a signal from such sensor (via conductor 67*b*). The machine controller mechanism 64 thereupon instructs the diverter mechanism to direct accepted coins to the coin elevator 70 for flow from the top of the column of coins therein through the elevator's discharge port and coin flow line 56*a* to the hopper for deposit at the top of the column of coins therein.

In the event of an immediate high volume payout or discharge of coins from the payout hopper 56 via hopper out chute 56*b*, the level of coins therein may drop suddenly well below the coin level sensor S3 within the hopper. Since the elevator controller mechanism 65 also receives a signal from the coin level sensor S3 (via conductor 67*b*, auto-switch 67 and conductor 67*a*) that coins are being discharged from hopper 56, such controller instructs the coin elevator's drive means, via conductor 65*b*, to refill the hopper 66 by upward movement of the coin platform within the elevator (as described hereinafter) whereby coins from the column of coins within the elevator are discharged through the elevator's coin discharge port into the hopper. The discharge and flow of coins from the discharge port of the elevator (through coin flow line 56*a*) into the coin hopper is assisted by a coin mixing device as will be later described.

When the payout hopper 56 has been refilled by coins from elevator 70, sensor S3 (proximate the top of hopper) signals the elevator controller mechanism 65 (via conductor 67*b*, auto-switch 67 and conductor 67*a*)) and such mechanism instructs the elevator's drive means (via conductor 65*b*) to move the coin platform downwardly within the elevator housing. At the same time the machine controller mechanism 64 instructs the coin diverter mechanism 54 of the apparatus and system to direct accepted coins into the coin elevator via input chute 70*a*. The coin platform within the elevator 70 descends to successive lower positions within the elevator housing, as directed by the elevator controller mechanism 65, based upon the sensed build-up of coins at the top of the column of coins within the elevator housing EH and the failure of coin flow through coin flow line 56*a* to the hopper 56 because the hopper is at its "full" status. The coin platform ceases its descent when the presence of the platform is detected by sensor S5 (proximate the bottom of the elevator) and such sensor signals the elevator controller mechanism 65 (via conductor 65*a*) to stop the elevator's drive means. As previously indicated, when the lower platform level sensor S5 establishes that the platform is at its lowest permissible level within the elevator housing EH, and coins have built up as a column on the elevator platform to the point whereat they reach upper coin level sensor S6 (threshold sensor), sensor S6 signals the machine controller mechanism 64 (via conductor 65*d*, the elevator controller mechanism, conductor 67*a*, auto-switch 67 and conductor 64*a*) and such mechanism instructs the coin diverter 54 to direct the flow of accepted coins into the drop bucket via drop chute 66*a*. It is to be noted and understood that electrical power for the operation of the coin operated and handling apparatus and system of the present invention may be supplied via power lines interconnected to the machine controller mechanism 64 and to the elevator controller mechanism 65

As previously indicated, PIGS. 4 and 5 show a preferred form of the supplemental coin storage, transportation and dispensing apparatus (coin supply elevator 70 of FIG. 3) of the present invention for incorporation in coin operated and handling apparatus. FIG. 4 is a front sectional view of the coin supply elevator and FIG. 5 is a side sectional view thereof. The elongated elevator 70 is defined by a housing EH comprised of a front wall 72 with coin input chute 70*a*, a rear wall 74, a side wall 76, and a side wall 78 with an upper coin discharge port 78*a* having a lower edge or lip 78*b*. The upper end of elevator 70 is closed by top wall 80 and the lower end of the elevator is closed by bottom wall 82. Extending centrally of the elevator housing EH, from the top wall 80 to the bottom wall 82, is a threaded, rotatable drive shaft 84, such shaft being supported in the top wall by an upper bearing set 86 and in the bottom wall by a lower bearing set 88. A coin support platen or elevator coin platform 90 is carried by, and is moveable upwardly and downwardly on, the drive shaft 84 by its threaded connector portion 92.

The elevator housing EH is situated on, and associated with, a motor and motor drive housing MH which is comprised of front wall 94, rear wall 96, side wall 98, side wall 100 and bottom wall 102. The threaded drive shaft 84 for elevator platen 90 extends downwardly into housing MH for interconnection with a drive pulley 104. Also located within housing MH is a motor set 106 including a motor pulley 108 which is mechanically drive-linked to pulley 104 by a pulley belt 110. The motor set 106, within housing MH, is interconnected to a power supply unit 112 and control circuitry 114 which is in turn interconnected with the elevator controller mechanism 65 of the coin operated and handling apparatus and system of FIG. 3. As the motor set 106 is energized (under the direction of control circuitry 114 and elevator controller mechanism 65) for forward or reverse rotation, the threaded drive shaft 84 rotates in a forward or reverse direction lifting or lowering the coin platform 90 thereby moving the column of coins carried by the platform in an upward or downward direction. The coin platform 90 is provided with a probe member **90*a* which acts to contact the top platform level sensor S4 within the housing to stop upward movement of the platform 90**.

Located within the elevator housing EH are the four sensing devices S4, S5, S6 and S7 previously described in relation to the operation of the apparatus and system of the invention as illustrated in FIG. 3. Thus, sensor S4 at the top of elevator housing EH is the sensor which is contacted by elevator platform probe **90*a* and thereupon signals the elevator controller mechanism 65 (FIG. 3) to stop upward movement of the platform 90. Sensor S5, proximate the lower end of the elevator housing, is the sensor of FIG. 3 which signals the elevator controller mechanism 65 (FIG. 3) to stop downward movement of the coin platform 90. Sensor S6, proximate the lower edge 78*b* of the coin discharge port 78*a* of the elevator housing EH, is the coin level sensor (threshold sensor) of FIG. 3 which is activated by its contact with the top level of coins on the platform 90 and signals the machine controller mechanism 64 and elevator controller mechanism 65 that coins are available within the elevator for discharge into the coin hopper. Finally, sensor S7, proximate the lower end of the elevator housing EH, is the coin level sensor that signals the elevator controller mechanism 65** (in cooperation with the sensor S6) that the elevator has reached a "full" status.

Figure 6:
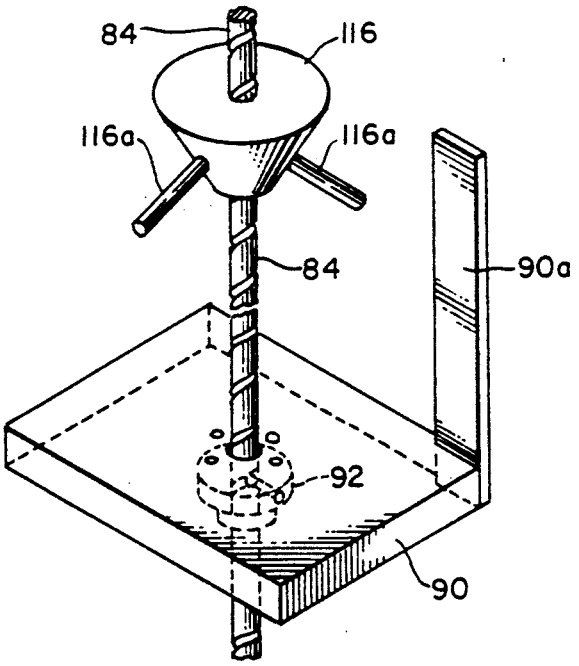
FIG. 6 is a perspective view of the moveable coin or token platen, platen support and lift drive shaft, and the coin or token mixer of the coin supply elevator of FIGS. 4 and 5.

Located on, and affixed to, the upper end of the threaded drive shaft 84 which lifts or lowers the coin platform 90 within elevator housing EH, is a coin mixing device 116 which rotates with such drive shaft when the latter is rotating during the lifting or descending action respecting coin platform 90. FIG. 6 further illustrates, in a perspective view, the moveable platen or coin platform 90, platen support and lift drive shaft 84, and the coin mixer 116 of the coin supply elevator of FIGS. 4 and 5. The coin mixer 116 includes mixer blades or mixer projections **116*a* which, during rotation of the mixer unit, deflect coins entering the top of the coin elevator 70 via input chute 70*a* and spread such coins across the top of the column of coins within the elevator and deflect coins outwardly of the discharge port 78*a* to the payout hopper 56** (FIG. 3).

While the invention has been described in connection with a general scheme of system components and particular embodiment of a supplemental coin elevator for application to a coin operated and handling apparatus, variances and modifications in the system and the specific embodiment will be apparent to those skilled in the art. Accordingly, such modifications are to be included within the spirit and scope of the invention as defined by the following claims.

What I claim is:

1. In a coin operated and handling apparatus having a coin acceptor device, a coin diverter mechanism, a hopper payout assembly including a coin hopper having coin level sensing means for detecting when said hopper is filled with coins and when said hopper is not filled with coins, a coin storage chamber, a coin return and delivery tray, first coin chute means for directing rejected coins from said acceptor device directly to said coin tray, second coin chute means for directing accepted coins from said acceptor device to the coin diverter mechanism, first coin directing means in coin flow communication with the coin diverter mechanism for directing accepted coins from said diverter mechanism to the hopper payout assembly, second coin directing means in coin flow communication with the coin diverter mechanism for directing accepted coins from said diverter mechanism to the coin storage chamber, and controller means in electrical communication with the coin level sensing means within said coin hopper and with the coin diverter mechanism and responsive to the coin level sensing means of said coin hopper for directing said diverter mechanism to pass accepted coins to said first coin directing means and the payout hopper assembly or to pass accepted coins to said second coin directing means and the coin storage chamber, said controller means being in electrical communication with said hopper payout assembly for directing the payout of coins from said hopper to said coin tray, the improvement comprising:

a supplemental coin storage, transport and dispensing mechanism interposed within the first coin directing means and comprising a coin supply elevator including an elevator housing, an upwardly and downwardly moveable coin platform within said housing, drive means for said elevator for effecting the upward and downward movement of said coin platform, a coin input chute for delivering accepted coins to said elevator housing for deposit as a column of coins on said coin platform, a coin discharge port in the upper portion of said elevator housing for delivering accepted coins to said payout hopper assembly, and coin level and platform level sensing means for detecting when said elevator is filled with coins and when the elevator platform is at its highest permissible level of upward travel within the elevator housing and when said platform is at its lowest permissible level of travel within said housing, said coin input chute being in coin flow communication with the coin diverter mechanism through said first coin directing means, said controller means being in electrical communication with and responsive to said coin level and platform level sensing means within said elevator housing for directing said diverter mechanism to pass accepted coins to said coin input chute and coin supply elevator as said first coin directing means, said controller means being in electrical communication with said drive means for effecting the upward and downward movement of said coin platform within the elevator housing, and said controller means being in electrical communication with said hopper payout assembly for directing the payout of coins from said hopper to said coin tray.

2. The coin operated and handling apparatus as claimed in claim 1 wherein the moveable coin platform within the elevator housing of the coin supply elevator is provided with a centrally located threaded opening and the drive means of said elevator for effecting the upward and downward movement of said coin platform comprises an elongated drive shaft seated within said opening and bearing mating threads along its length and a reversible electric motor mechanically interconnected to said drive shaft for forward and reverse rotation of said shaft.

3. The coin operated and handling apparatus as claimed in claim 2 wherein the elongated drive shaft for effecting upward and downward movement of the coin platform within the elevator housing of the coin supply elevator has mounted at the upper end thereof a coin mixer which rotates with said shaft and assists in the distribution of coins entering said elevator through the coin input chute thereof to the elevator platform and through the coin discharge port of said elevator to the hopper of the hopper payout assembly.

4. The coin operated and handling apparatus as claimed in claim i wherein the controller means includes a machine controller mechanism and an elevator controller mechanism, said machine controller mechanism being in electrical communication with: the coin level sensing means within the coin hopper and with the coin diverter mechanism and responsive to the coin level sensing means of said hopper; the elevator controller mechanism; and the hopper payout assembly for directing the payout of coins from the coin hopper to the coin return and delivery tray, said elevator controller mechanism being in electrical communication with and responsive to the coin level and platform level sensing means within the elevator housing for directing said diverter mechanism to pass accepted coins to the coin input chute and coin supply elevator, and said elevator controller mechanism being in electrical communication with the drive means of said coin supply elevator for effecting the upward and downward movement of the coin platform with in the elevator housing of said elevator.

5. In a coin operated and handling apparatus having a coin acceptor device, a coin diverter mechanism, a hopper payout assembly including a coin hopper having a coin level sensor, a coin storage chamber, a coin return and delivery tray, a first coin chute for transferring rejected coins from the coin acceptor device to the coin return and delivery tray, a second coin chute for transferring accepted coins from the coin acceptor device to the coin diverter mechanism, first coin directing means in coin flow communication with the coin diverter mechanism for directing accepted coins from the coin diverter mechanism to the hopper payout assembly, second coin directing means in coin flow communication with the coin diverter mechanism for directing accepted coins from the coin diverter mechanism to the coin storage chamber, and machine controller means in electrical communication with the coin level sensor within the coin hopper and with the coin diverter mechanism and responsive to the coin level sensor for directing the coin diverter mechanism to pass accepted coins to the first coin directing means and the payout hopper assembly or to pass accepted coins to the second coin directing means and the coin storage chamber, the machine controller means being in electrical communication with the hopper payout assembly for directing the payout of coins from the coin hopper to the coin return and delivery tray, the improvement comprising:

a) a supplemental coin storage, transport and dispensing mechanism interposed within the first coin directing means and comprising a coin supply elevator including an elevator housing, an upwardly and downwardly moveable coin platform within said housing, a coin input chute for delivering accepted coins to said elevator housing for deposit as a column of coins on said coin platform, a coin discharge port in said elevator housing for delivering accepted coins to said payout hopper assembly, and coin level and platform level sensors for detecting when said elevator is filled with coins and when the elevator platform is at its highest and lowest permissible levels of travel within said housing, said coin input chute being in coin flow communication with the coin diverter mechanism; and b) an elevator controller mechanism in electrical communication with the machine controller mechanism, said elevator controller mechanism being in electrical communication with and responsive to the coin level and platform level sensors within the elevator housing for directing the coin diverter mechanism to pass accepted coins to the coin input chute and coin supply elevator.

6. The coin operated and handling apparatus as claimed in claim 6 wherein a reversible motor is located within the lower portion of the elevator housing and includes drive means associated with said motor for effecting the upward and downward movement of the movable coin platform within the elevator housing, said motor being in electrical communication with and responsive to the elevator controller mechanism.

7. The coin operated and handling apparatus as claimed in claim 6 wherein the movable coin platform within the elevator housing of the coin supply elevator is provided with a centrally located threaded opening and the drive means associated with the reversible motor within the elevator housing for effecting the upward and downward movement of said coin platform comprises an elongated shaft seated within said opening and bearing mating threads along its length.

8. The coin operated and handling apparatus as claimed in claim 7 wherein the elongated drive shaft for effecting upward and downward movement of the coin platform within the elevator housing of the coin supply elevator has mounted at the upper end thereof a coin mixer which rotates with said shaft and assists in the distribution of coins entering said elevator through the coin input chute thereof to the elevator platform and through the coin discharge port of said elevator to the hopper of the hopper payout assembly.

* * * * *